US008237111B2

(12) United States Patent
Golikov et al.

(10) Patent No.: US 8,237,111 B2
(45) Date of Patent: Aug. 7, 2012

(54) MULTI-REFLECTING ION OPTICAL DEVICE

(75) Inventors: Uriy Golikov, St. Petersburg (RU); Konstantin Solovyev, St. Petersburg (RU); Mikhail Sudakov, Ryazan (RU); Sumio Kumashiro, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 201 days.

(21) Appl. No.: 12/666,252

(22) PCT Filed: Jun. 20, 2008

(86) PCT No.: PCT/JP2008/061677

§ 371 (c)(1),
(2), (4) Date: Mar. 23, 2010

(87) PCT Pub. No.: WO2009/001909

PCT Pub. Date: Dec. 31, 2008

(65) Prior Publication Data

US 2010/0193682 A1 Aug. 5, 2010

(30) Foreign Application Priority Data

Jun. 22, 2007 (GB) ..... 0712252.6

(51) Int. Cl.
*H01J 49/40* (2006.01)

(52) U.S. Cl. ..... 250/287

(58) Field of Classification Search ..... 250/281, 250/282, 287, 292

See application file for complete search history.

(56) References Cited

U.S. PATENT DOCUMENTS

| | | | | |
|---|---|---|---|---|
| 4,625,112 | A | 11/1986 | Yoshida | |
| 7,326,925 | B2 * | 2/2008 | Verentchikov et al. | 250/287 |
| 7,772,547 | B2 * | 8/2010 | Verentchikov | 250/287 |
| 7,982,184 | B2 * | 7/2011 | Sudakov | 250/287 |
| 2001/0011703 | A1 * | 8/2001 | Franzen | 250/287 |
| 2006/0214100 | A1 * | 9/2006 | Verentchikov et al. | 250/287 |
| 2010/0072363 | A1 * | 3/2010 | Giles et al. | 250/287 |

FOREIGN PATENT DOCUMENTS

| | | | |
|---|---|---|---|
| GB | 2 080 021 | A | 1/1982 |
| SU | 1247973 | A1 | 7/1986 |
| SU | 1725289 | A1 | 4/1992 |
| WO | 2005/001878 | A2 | 1/2005 |
| WO | 2006/102430 | A2 | 9/2006 |
| WO | 2007/044696 | A1 | 4/2007 |

OTHER PUBLICATIONS

P.W. Hawkes et al., "Principles of Electron Optics", Academic Press, 1996, pp. 90-91, vol. 1.

(Continued)

*Primary Examiner* — David A Vanore
*Assistant Examiner* — Johnnie L Smith
(74) *Attorney, Agent, or Firm* — Sughrue Mion, PLLC

(57) ABSTRACT

A multi-reflecting ion optical device includes electrostatic field generating means configured to generate electrostatic field defined by a superposition of first and second distributions of electrostatic potential $\Phi_{EF}$, $\Phi_{LS}$. The first distribution $\Phi_{EF}$ subjects ions to energy focusing in a flight direction and the second distribution $\Phi_{LS}$ subjects ions to stability in one lateral direction, to stability in another lateral direction for the duration of at least a finite number of oscillations in the one lateral direction and to subject ions to energy focusing in the one lateral direction for a predetermined energy range.

16 Claims, 6 Drawing Sheets

OTHER PUBLICATIONS

N.V. Konenkov et al., "Matrix Methods for the Calculation of Stability Diagrams in Quadrupole Mass Spectrometry", JASMS, 2002, pp. 597-613, vol. 13.

European Office Action dated Dec. 1, 2010 for corresponding application.

Russian Office Action dated Apr. 17, 2012, issued in corresponding Russian Patent Application No. 2010101923.

* cited by examiner

MULTI-REFLECTING ION OPTICAL DEVICE

FIELD OF THE INVENTION

This invention relates to multi-reflecting ion optical devices. The invention relates particularly, though not exclusively, to multi-reflecting time-of-flight (TOF) mass analysers; that is, TOF mass analysers having increased flight path due to multiple reflections, and to TOF mass spectrometers including such TOF mass analysers. The invention also relates to multi-reflecting ion optical devices in the form of an ion trap; for example, an electrostatic ion trap employing image current detection, an ion trap arranged to carry out mass-selective ion ejection, and an ion trap used as an ion storage device.

BACKGROUND

Accurate measurement of the masses of atoms and molecules (mass-spectrometry) is one of the most efficient methods for qualitative and quantitative analysis of chemical compositions of substances. The substance under investigation is first ionised using one of a number of available ionisation methods (e.g. electron impact, discharge, laser irradiation, surface ionization, electro-spray). In time-of-flight (TOF) mass spectrometers ions are extracted from an ion source as discrete ion pulses using an electric field and, after acceleration, are directed into a flight path of the analyser. Due to the laws of motion in an electrostatic field the flight times of ions having different mass-to-charge ratios (but the same average energy) is proportional to the square root of mass-to-charge ratio. Thus, ions are separated into discrete packets according to their mass-to-charge ratios and can be registered sequentially by a detector to form a mass spectrum.

The higher the total flight times of ions in the TOF analyser, the better the resolving power of mass analysis. For this reason several types of TOF mass analyser with increased flight path due to multiple reflections have been developed. Increasing the flight time of ions, while keeping the size of the ion packets sufficiently small, is a difficult task because of a spread of initial positions of ions inside the source, which results in a deviation of kinetic energy from an average value (energy spread) and due to spread of initial ion velocities which results in so-called turn-around time and a lateral angular spread of the beam. In order to obtain a mass spectrum in a wide mass range with high sensitivity it is desirable to satisfy several conflicting conditions at the same time; that is, to: 1) avoid looping of the beam trajectory; 2) ensure lateral stability of the ion beam and; 3) obtain space-energy focusing at the surface of the detector with minimum aberrations. Because of this, the development of multi-reflecting TOF (mTOF) system has involved optimisation of the ion optics in order to increase acceptance; that is the volume of phase space which can be accepted by the system. So far, the problem has been addressed in the main using sophisticated optimisation software, although each particular design has inherent advantages and disadvantages.

Although the acceptance of existing multi-reflecting TOF systems is suitable for many ion sources which employ cooling using buffer gas and high extraction fields, such systems are not well suited directly to accept ions having wide energy and angular spread as produced, for example by a matrix-assisted laser desorption/ionization (MALDI) ion source.

PRIOR ART

A number of electrostatic systems employing multiple reflections were proposed by H. Wollnik in UK patent GB2080021 (FIG. 1). Systems described by H. Wollnik involve complicated manufacturing processes and careful optimisation. A simpler system is described in Soviet Union Patent SU1725289 of Nazarenko et al (FIG. 2). Their system has two parallel gridless ion mirrors to provide multiple reflections. Ions are injected into the system at a small angle with respect to the Z-axis (flight) direction. As a result ions travel comparatively slowly in the X-axis (drift) direction while being reflected between two parallel mirrors thus creating a multiply folded zigzag-like trajectory with the increased flight time. Unfortunately, this system lacks any means to prevent beam divergence in the drift direction. Due to an initial angular spread, the width of the beam may exceed the width of the detector making further increase of ion flight time impractical due to loss of sensitivity.

A significant improvement of the multi-reflecting system based on two parallel planar mirrors was proposed by A.Verentchikov and M.Yavor in WO2005/001878 A2. Angular beam divergence in the drift direction was compensated by a set of lenses positioned in a field free region between the mirrors (FIG. 3). As in a system of Nazarenko, ions are injected into a space between the mirrors at a small angle with respect to the X axis (flight) direction but the angle is chosen such that the ion beam passes through a set of lenses 17. As a result, the ion beam is refocused after every reflection and does not diverge in the X-axis (drift) direction. High resolving power results from an optimum design of the planar mirrors which not only provide third order energy focusing, but also have minimum lateral aberrations up to the second order. Also, the design described in WO2006/102430 A2 is advantageous compared with the system described by Nazarenko in that it provides complete lateral stability in the drift direction with the help of lenses. At the same time, lenses are known to introduce inevitable aberrations, which reduce the overall acceptance of the system.

These disadvantages of existing systems are addressed by present invention.

SUMMARY OF THE INVENTION

According to the invention there is provided a multi-reflecting ion optical device comprising electrostatic field generating means configured to generate electrostatic field defined by a superposition of first and second mutually independent distributions of electrostatic potential $\Phi_{EF}$, $\Phi_{LS}$, whereby ion motion in a flight direction is decoupled from ion motion in lateral directions, orthogonal to the flight direction, said first distribution of electrostatic potential $\Phi_{EF}$, being effective to subject ions having the same mass-to-charge ratio to energy focusing with respect to the flight direction and said second distribution of electrostatic potential $\Phi_{LS}$, being effective is subject ions to stability in one said lateral direction, to stability in another said lateral direction for the duration of at least a finite number of oscillations in said one lateral direction and to subject ions having the same mass-to-charge ratio to energy focusing with respect to said one lateral direction for a predetermined energy range. In preferred embodiments, the ion optical device has the form of a multi-reflecting time-of-flight mass analyser.

The inventors have realised that the acceptance of a multi-reflecting ion optical device, such as a multi-reflecting TOF mass analyser, can be substantially increased if the conflicting tasks of ion beam lateral stability and longitudinal energy focusing are treated separately by creating independent distributions of electrostatic potential. This provides a significant improvement of existing multi-reflecting TOF analysers. The ion optical device of the invention can be also used (and have a number of unique advantages) as an ion trap with image current detection involving processing using a Fourier transform in order to obtain mass spectra, as an ion trap with mass-selective ejection (using several methods) of ions towards an ion detector or simply as a storage device for ions.

BRIEF DESCRIPTION OF DRAWINGS

Embodiments of the invention are now described, by way of example only, with reference to the accompanying drawings of which.

DESCRIPTION OF PREFERRED EMBODIMENTS

Figure 1:
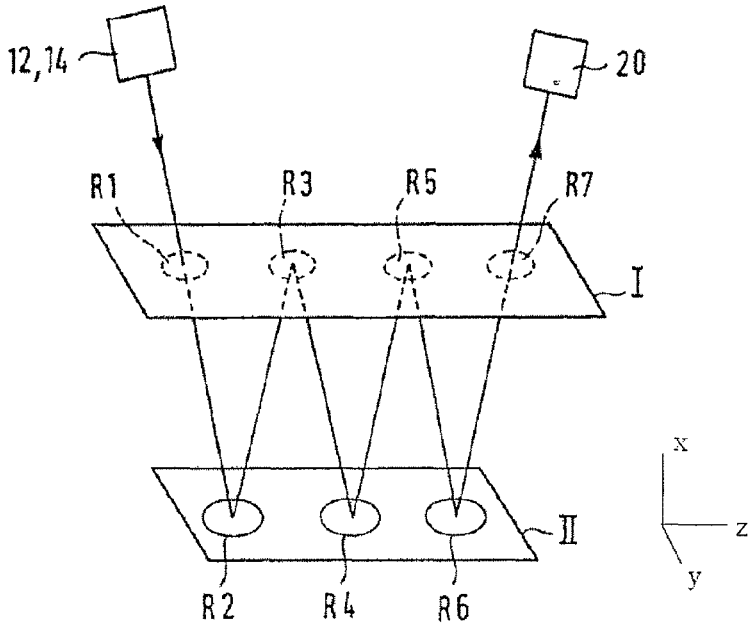
FIG. 1. is a schematic representation of a known axially-symmetric multi-reflecting TOF mass spectrometer described by H. Wollnik in GB 2080021, FIG. 2. is a schematic representation of a known, planar, multi-reflecting TOF mass spectrometer described by Nazarenko in SU 1725289, FIG. 3. is a schematic representation of a known, planar, multi-reflecting TOF mass spectrometer described by Verentchikov and Yavor in WO 2005/001878A2, FIG. 4. illustrates an example of the distribution of electrostatic potential $\phi(x)$ in the lateral X-axis direction of an ion optical device according to the invention, FIG. 5. shows an example of an electrode structure of an ion optical device according to the invention, FIG. 6. shows another example of the distribution of electrostatic potential $\phi(x)$ in the lateral X-axis direction, of an ion optical device according to the invention, FIG. 7. illustrates the variation of half period of oscillations in the X-axis direction as a function of energy for the distribution $\phi(x)$ of FIG. 6, FIG. 8A, 8B and 8C respectively illustrate the trajectories of ions in the XY, YZ and XZ planes of ion optical device according to the invention having the distribution $\phi(x)$ shown in FIG. 6, FIG. 9. shows an electrode structure having an internally mounted ion source.
Figure 2:
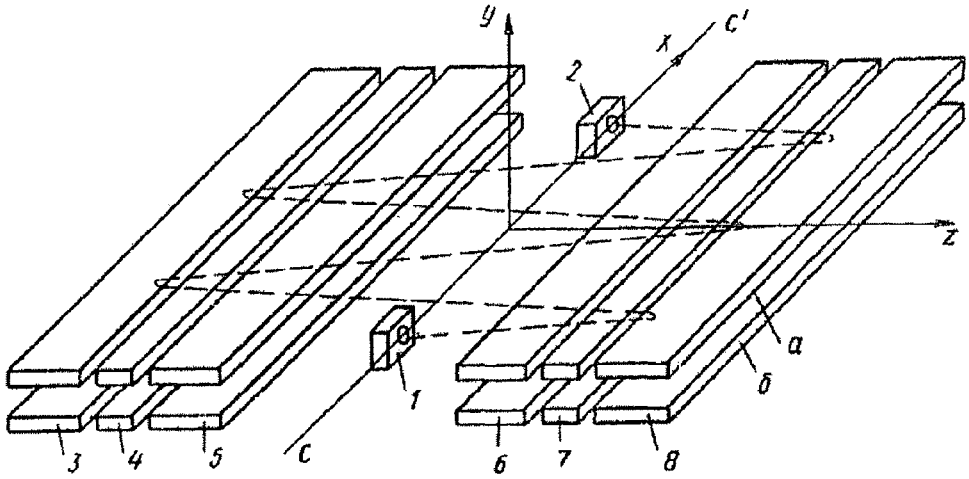
Figure 3:
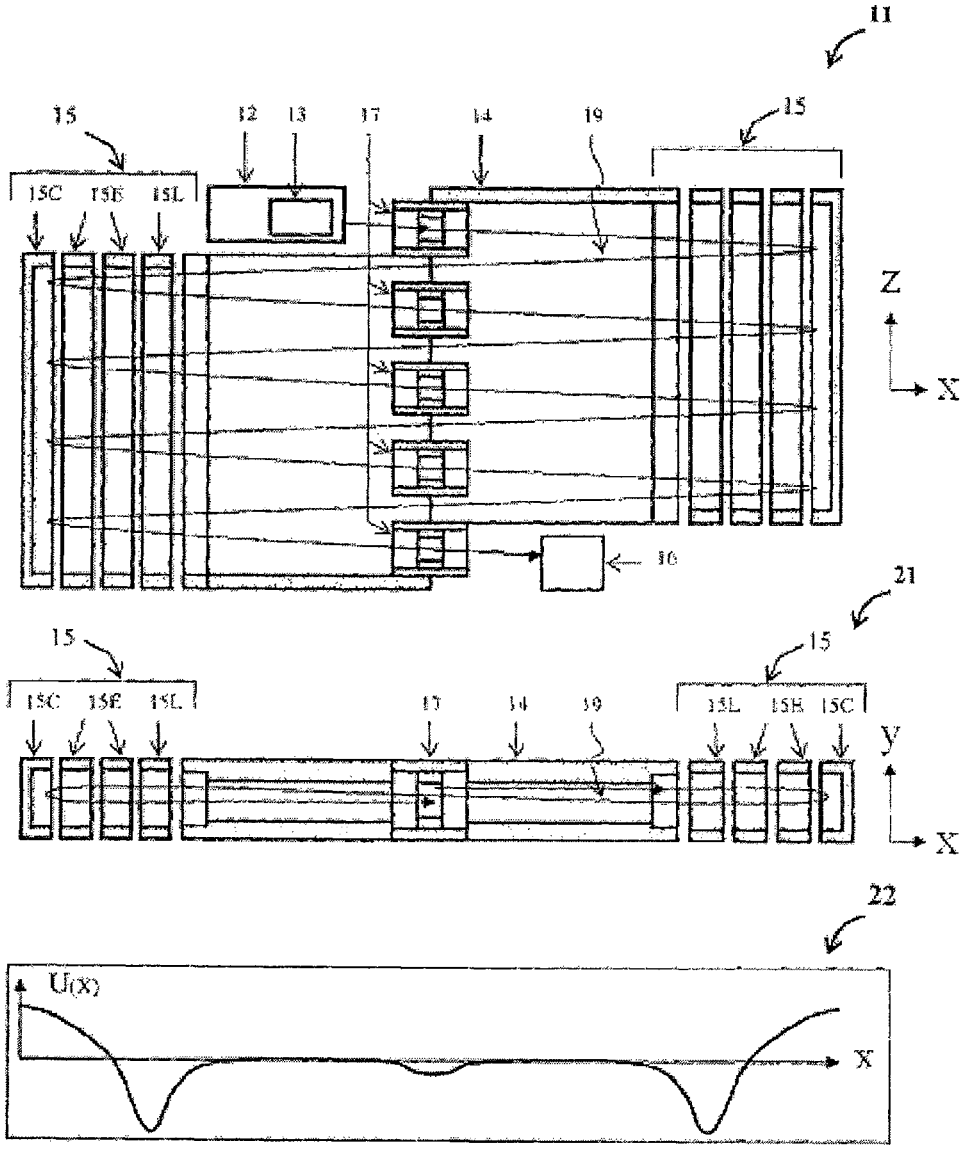

The TOF method requires the time duration ($\delta t$) of ion pulses of similar mass-to-charge (m/e) ratio to be as short as possible when they arrive at the surface of detector. This is because resolving power of mass analysis ($R_m$) is given by: $R_m=0.5\cdot T/\delta t$, where T is the flight time. Detectors used in TOF mass spectrometry (e.g. MCP or Dynode Electron multipliers) usually have a flat surface where ions arrive producing several secondary electrons, which are then multiplied by an electron multiplier. Thus, the recording system actually detects a pulse of electrons when an ion arrives at the surface of the detector. Many ions of similar mass may arrive at slightly different times thus producing an averaged peak in the mass spectrum. In order to reduce ($\delta t$) it is desirable to ensure that ion packets are as narrow as possible in the direction orthogonal to the surface of detector, while in other directions the pulse can be as wide as the detector. It follows from this that it is desirable to ensure that ion pulses ejected from an ion source become narrow (i.e. space-energy focused) with respect to one of the directions along the ion trajectory. This direction will be further referred as the "flight direction". Directions orthogonal to the flight will be referred as "lateral directions". In the description that follows, adopting a Cartesian coordinate system, the Z-axis direction will be referred to as the "flight direction" and the mutually orthogonal X and Y-axis directions will be referred to as the "lateral directions".

In the lateral directions the requirement is that the beam remains narrower than the width of the detector. Due to a spread of initial ion velocity in the lateral directions ions tend to spread out laterally along the flight direction, and in many existing TOF mass analysers the beam may become significantly wider than the detector thus compromising the sensitivity of analysis. In TOF systems for which the ion time-of-flight is increased due to multiple reflections it is essential to ensure lateral stability of the beam. In accordance with the present invention this is accomplished by refocusing the beam using a special design of electrostatic field. For the purpose of the present description "stability" of ion motion in a particular direction (the Y-axis direction, say) is defined as a requirement that the particle position remains within certain boundaries: i.e. $y_{min}<y<y_{max}$. If this is true for an infinite time, then stability is considered to be "fundamental"; otherwise if this condition applies only for a limited time period, then stability is considered to be "marginal". For example, oscillations of ions within a one-dimensional potential well exhibit "fundamental" stability due to the energy conservation property. Fundamental stability in both lateral (X-Y-axis) directions is preferable, although this is not a strict limitation and "marginal" stability may also be acceptable. It will be understood that stability of oscillations is not equivalent to the "energy isochronous" property. The latter requires that ions starting at the same time from the same location with different initial energies will all arrive at another location (referred to as the focus point) at substantially the same time. This property is further explained by reference to the following Taylor series expansion of flight time as a function of ion energy:

$$T(K)=T_0+A_{k+1}(K-K_0)_{k+1}+A^{k+2}(K-K_0)^{k+2}+\ldots \quad (1)$$

Here $T_0$ is the flight time for an ion of energy $K_0$, and coefficients $A_k$ are constants. As can be seen from equation 1 the first few terms are equal to zero i.e. $A_1=A_2=\ldots=A_k=0$. In this case, the system is referred to as being energy-isochronous to k-th order; that is, to k-th order, the flight time $T_0$ is independent of energy K. For a system having a quadratic potential distribution all coefficients $A_k$ are zero. Such systems are referred as systems exhibiting "ideal" space-energy focusing. It is worth mentioning that a system can be energy-isochronous, even though ion motion lacks stability, and the known reflectron TOF system is an example of this.

Hitherto, it has proved difficult simultaneously to satisfy the requirement for both lateral stability of an ion pulse and energy focusing of the ion pulse with respect to the flight direction, and this problem has usually been addressed using sophisticated optimisation software. The "figure of merit" of such optimisation is expressed in terms of the acceptance (that is, the area in phase space) in the mutually orthogonal lateral (X-Y-axis) directions and maximum energy spread $\Delta K/K$ in the (Z-axis) flight direction for which an acceptable resolving power can be attained. Typically, in hitherto known systems, a resolving power of several tens of thousands has been achieved provided the acceptance is no greater than about 1 mm*20 mrad in both lateral directions and the energy spread is no greater than a few percent, although the system described by Verenchikov and Yavor in WO 001878 is reported to have achieved a maximum resolving power of 30,000 with an acceptance as high as 10 $\pi$ mm*mrad in each lateral direction and an energy spread of 5% in the flight direction.

The present inventors have realised that the acceptance of a multi-reflecting ion optical device such as a multi-reflecting TOF mass analyser can be considerably increased by separating the conflicting requirements of energy focusing in the flight direction and lateral stability into two independent subsystems by an appropriate selection of field configuration. For example, this can be accomplished using an electrostatic field defined by a distribution of electrostatic potential consisting of two parts as follows:

$$\phi(x,y,z)=\phi_{EF}(x,y,z)+\phi_{LS}(x,y,z). \tag{2}$$

Here, the electrostatic potential $\phi(x,y,z)$ satisfies the Laplace equation, while the functions $\phi_{EF}(x,y,z)$ and $\phi_{LS}(x,y,z)$ are of general form. According to the present invention field $\phi_{EF}$ is responsible for energy focusing in the (Z-axis) flight direction, and field $\phi_{LS}$ ensures beam stability in both lateral (X-, Y-axis) directions.

Considering first the requirement of energy focusing, ideal energy focusing for an infinite energy range can be achieved in the Z-axis direction using a "quadrupole" field of the form:

$$\Phi_{EF}(y,z)=V_z\frac{z^2-y^2}{l^2}, \tag{3}$$

where $V_z$ is the magnitude of electrostatic potential and l is a characteristic distance. The potential distribution has a quadratic dependence in the Z-axis direction and the equation of motion for an ion of mass m and charge e in this direction is as follows:

$$m\frac{d^2z}{dt^2}+2e\frac{V_z}{l^2}z=0. \tag{4}$$

The solution for this equation is a sinusoidal function with a secular frequency $$\Omega_z=\sqrt{\frac{2eV_z}{ml^2}}. \tag{5}$$

The amplitude and phase of the sinusoidal function depends on initial conditions of the ion. For our purpose we need to consider particles which start at the same time from the same location $z_0$, but with different initial velocities $v_0$; that is, $$z(t)=z_0\cos\Omega t+\frac{v_0}{\Omega}\sin\Omega t. \tag{6}$$

It can easily be seen that after each complete cycle of period $T_z=2\pi/\Omega_z$ ions return to exactly the same location $z_0$ independently of their initial velocities. Thus, the total flight time is independent of ion energy. This "ideal energy focusing" property, which is exhibited by a quadrupole field, has been known for a long time in TOF mass spectrometry. Y. Yoshida in U.S. Pat. No. 4,625,112 describes how this property of the quadrupole field can be exploited to design an ion mirror for a TOF from a set of circular diaphragms. Unfortunately it is also known in the art that lateral motion of ions in a quadrupole field of the form defined by eq. 3 is unstable. This can easily be seen from eq. 3 by investigating ion motion in the y direction. That is why the design described by Y. Yoshida has little practical use and is particularly unsuitable for TOF mass analysers using multiple reflections. This example again demonstrates the difficulty in simultaneously satisfying the conflicting requirements of space—energy focussing over a wide energy range and of lateral stability.

SU 1247973 A1 teaches a method of designing an electrostatic field having a quadratic potential distribution in the Z-axis direction, while maintaining beam stability in one of the lateral directions. Such a field has an axial symmetry around Z-axis and is represented by a potential function (expressed in polar coordinates) of the form:

$$\phi(z,\rho)=V_z\left[\frac{z^2}{l^2}-0.5\frac{\rho^2}{l^2}+\mu\cdot\ln\left(\frac{\rho}{l}\right)\right],\ \rho=\sqrt{x^2+y^2}. \tag{7}$$

Here $$\Phi_{EF}=V_z\left[\frac{z^2}{l^2}\right]\text{ and }\Phi_{LS}=V_z\left[-0.5\frac{\rho^2}{l^2}+\mu\cdot\ln\left(\frac{\rho}{l}\right)\right].$$

With an appropriate choice of a dimensionless constant $\mu$ it is possible to ensure that radial motion is stable at least for some (quite wide) lateral velocity spread. At the same time, the beam in this system expands uncontrollably in the azimuthal direction because the potential distribution of eq. 7 has no dependence on azimuthal angle $\gamma$. Due to this drawback, this particular design, which is known in the art as an "Orbitrap," cannot be used efficiently for multi-reflecting TOF mass analyser applications.

As already explained, the distribution of electrostatic potential $\Phi_{EF}(z, y)$, defined by Equation 3, provides ideal energy focusing for unlimited energy range in the (Z-axis) flight direction. At the same time, lateral motion in this potential is unstable. With a view to alleviating this problem, the distribution of electrostatic potential $\Phi_{LS}$ is configured to ensure lateral stability of the beam within a wide acceptance. To that end, $\Phi_{LS}$ is configured as a 2D, planar distribution of electrostatic potential $\Phi_{LS}(x,y)$, so that lateral ion motion (in the X-Y plane) is completely decoupled from ion motion in the (Z-axis) flight direction and can be investigated separately. In this case the equations of motion in the lateral directions are as follows:

$$m\frac{d^2x}{dt^2}+e\frac{\partial\Phi_{LS}}{\partial x}=0, \tag{9a}$$

$$m\frac{d^2y}{dt^2}-2e\frac{V_z}{l^2}y+e\frac{\partial\Phi_{LS}}{\partial y}=0. \tag{9b}$$

It is appropriate for further investigation to express the potential function $\Phi_{LS}(x,y)$ in terms of an expansion over a power series in "y". This theoretical approach is quite realistic for systems under investigation due to the fact that ion motion takes place within a narrow slice near plane y=0. For harmonic functions this expansion is as follows (see for example P. W. Hawkes, E. Kasper, "Principles of Electron Optics", Academic Press, London, vol. 1, 1996, pp. 90,91) :

$$\Phi_{LS}=\phi(x)-\frac{y^2}{2}\phi''(x)+\frac{y^4}{24}\phi^{(4)}(x)-\frac{y^6}{720}\phi^{(6)}(x)+\ldots \tag{10}$$

Equation 10 is then substituted into equations of motion (9). In eq. 9a for motion in the X-axis direction terms up to first order in are neglected. Thus, the resulting equation of motion is as follows:

$$m\frac{d^2x}{dt^2} + e\frac{d\phi(x)}{dx} = 0. \tag{11}$$

Equation 11 describes ion motion in a potential well defined by a function $\phi(x)$. Potential distribution $\phi(x)$ is selected according with the following criteria:

1. Ions should undergo stable oscillations in the X-axis direction within the potential well,
2. The period of oscillations along the lateral X-axis direction should be substantially independent of particle kinetic energy $K_x$ within a certain energy range near $K_{xo}$.
3. Oscillations of the ions in the orthogonal Y-axis direction should be stable, preferably for an infinite time or at least for substantial number of oscillations in the X-axis direction.

Figure 4:
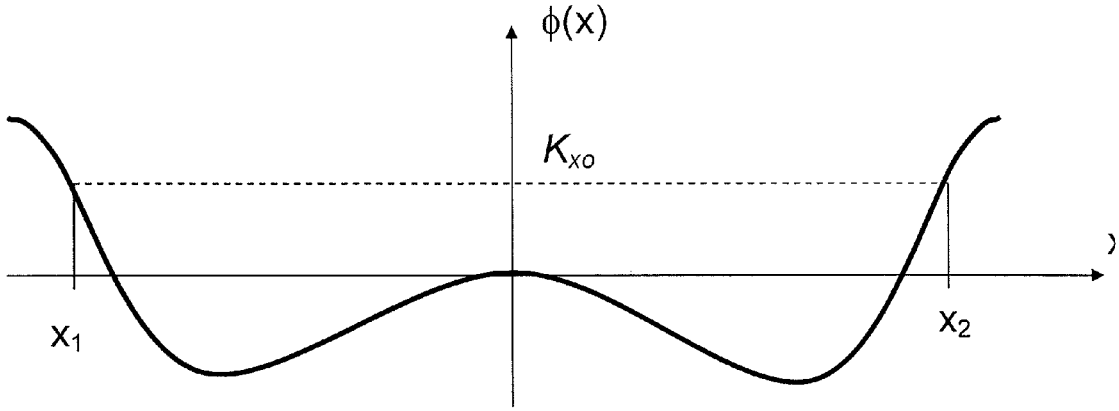

A function $\phi(x)$ can be always selected in such way as to satisfy those requirements; for example a potential function $\phi(x)$ of the form shown in FIG. 4. Ions undergo stable periodic ocillations between turning points $x_1$ and $x_2$ with constant energy $K_{xo}$ within a potential well. By appropriately optimising the potential function $\phi(x)$ the period of oscillations $T_x$ can be made substantially independent of kinetic energy $K_x$ for some range of energies near $K_{xo}$. In this case, ions of similar mass, but different energy will be energy-focused after every reflection in the lateral X-axis direction, which means that the lateral size of the beam in X-axis direction will remain finite for many reflections, provided that the energy spread is sufficiently small.

With regard to stability in the Y-axis direction, the equation of motion, taking account of second-order terms in y, is as follows:

$$m\frac{d^2y}{dt^2} - e\left[2\frac{V_z}{l^2} + \phi''(x)\right]y = 0. \tag{12}$$

Here, the second derivative of the potential distribution $\phi''(x)$ is a function of ion position along the X-axis. For ions having nominal energy $K_x$ the variation of x with time t can be derived from eq. 11 as follows:

$$t - t_0 = \sqrt{2}\int_{x_0}^{x}\frac{dx}{\sqrt{K_x - \phi(x)}}. \tag{13}$$

Equation 13 allows the position of an ion on the X-axis to be expressed in terms of flight time: x=f(t), where $f(t\pm T_x)=f(t)$. It follows that equation 12 describes ion motion in a periodic potential. The theory of such motion, has already been extensively investigated (for review of stability diagrams with different signals and stability conditions see, for example, M. Sudakov, D. J. Douglas, N. V. Konenkov, "Matrix Methods for the Calculation of Stability Diagrams in Quadrupole Mass Spectrometry", JASMS, 2002, v. 13, pp. 597-613). It is known that there are vast areas in a space of equation parameters which correspond to a stable motion of particles. For the present invention the existence of such regions of stable motion is all that matters.

An example according to the invention utilises a 2D distribution of electrostatic potential $\Phi_{LS}(x,y)$ in the XY plane defined by the following combination of analytical functions:

$$\Phi_{LS}(x, y) = -kx^2 - (1-k)y^2 + \sum_{i=0}^{3} A_i\varphi_0(x - x_i, y, a_i, b_i, c_i), \tag{14}$$

where $$\varphi_0(x, y, a, b, c) = 2xy\cdot s_1 + (x^2 - y^2 + c)\cdot s_2, \tag{15}$$

$$s_1 = -\frac{\sin 2ay}{2(\cos 2ay + \cosh 2a(x-b))},$$

$$s_2 = \frac{1}{2} + \frac{\sinh 2a(x-b)}{2(\cos 2ay + \cosh 2a(x-b))}$$

Coefficients of (14), (15) are given in the Tables 1 and 2.

TABLE 1

| i | $A_i$ | $a_i$ | $b_i$ | $c_i$ | $x_i$ |
|---|---|---|---|---|---|
| 0 | $B/h^2$ | 3 | H | $-h^2$ | 0 |
| 1 | $-B/h^2$ | 3 | −h | $-h^2$ | 0 |
| 2 | $-A/b^2$ | 3 | −b | $-b^2$ | h + b |
| 3 | $-A/b^2$ | −3 | B | $-b^2$ | −h − b |

TABLE 2

| A | b | B | h | k |
|---|---|---|---|---|
| 50 | 3 | 30 | 2 | 0 |

Realization of the invention by the system defined by the functions of Equations 14 and 15 with coefficients given in Tables 1 and 2 is not unique. Other variants are possible.

Note that here and in most of the following discussion dimensionless units are used: energy is expressed in units of $eV_z$ and distances are expressed in units of l. That is why corresponding constants are absent from equations 14 and 15. Time-of-flight is expressed in units of $\tau = l\cdot\sqrt{m/|eV_z|}$. An example of an electrode structure suitable for establishing such a field configuration is shown in FIG. 5.

Figure 6:
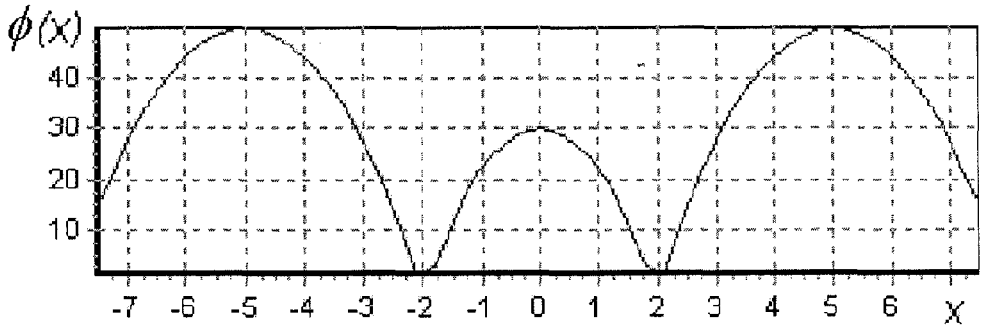
Figure 7:
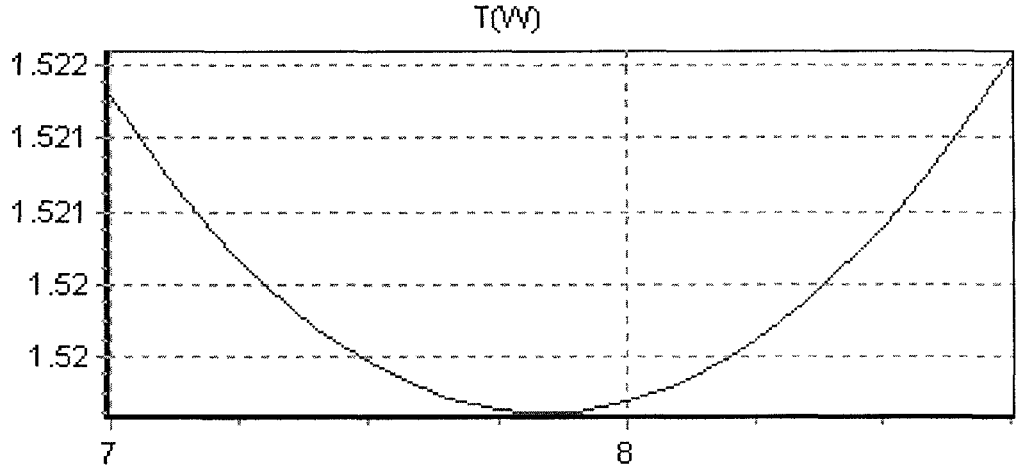
Figure 8:
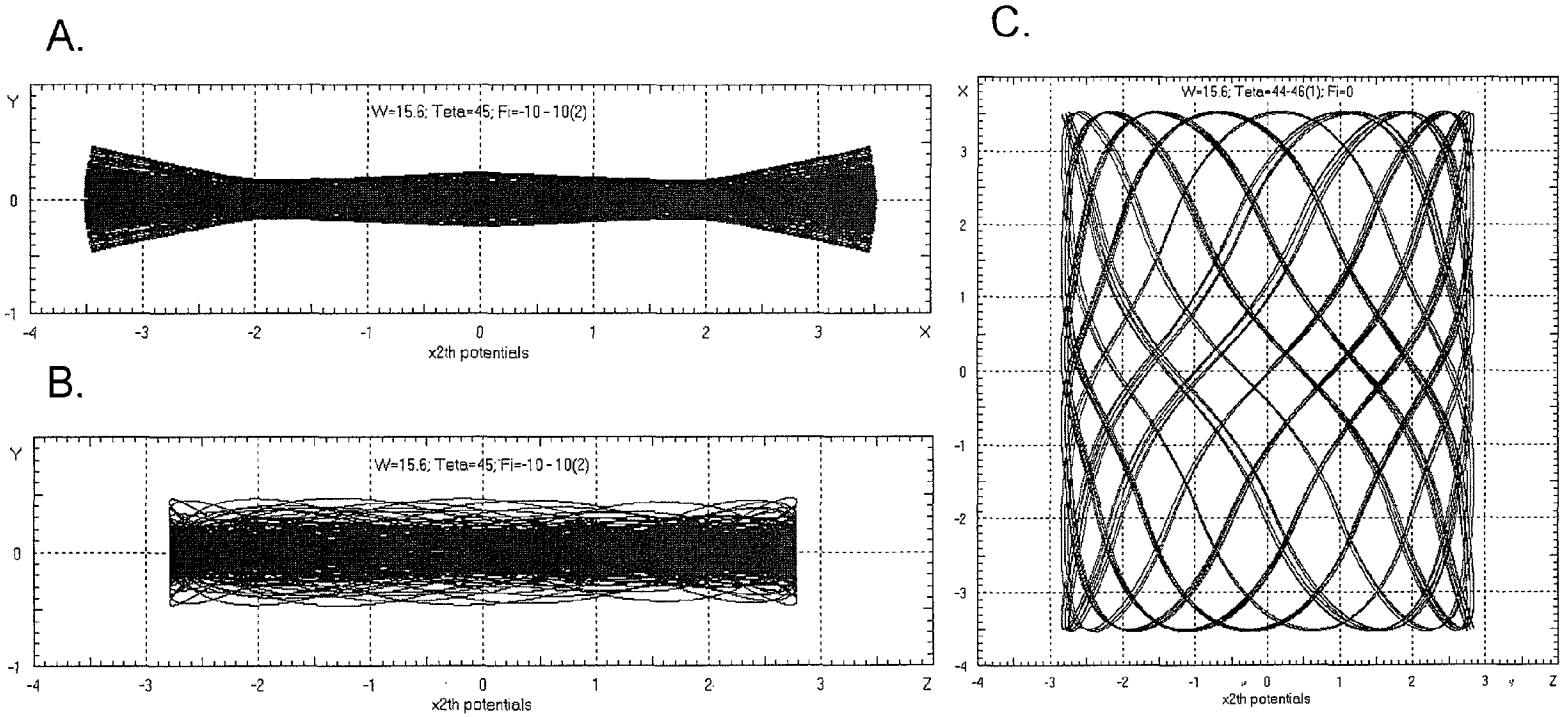

The distribution of electrostatic potential along the X-axis direction of this system (at Z=0) is shown on FIG. 6. Simulations show that the half period of ion oscillations along the X-axis direction in this potential depends on energy as shown on FIG. 7. It follows that this system has a first order focusing property (dT/dK=0) at an energy of approximately $W_x$=7.8 units. Investigation of equation 12 for this case shows also that ion motion in the Y-axis direction is stable for a wide range of initial conditions. FIG. 8 illustrates the trajectory of an ion packet within the system. A bunch of ions is injected at an average angle of 45° with respect to the Z-axis with a total energy of $W_x+W_z$=15.6 units. As a result of such injection, the beam has an average energy of 7.8 units in both the X-axis and the Z-axis directions. This value corresponds to an isochronous point for ion motion in the X-axis direction. The ion packet has a uniform distribution of total energy of 1.6 units, which corresponds to a relative energy spread of 10%. The angle of injection was uniformly distributed between 44 ° and 46° (i.e. angular spread)+/−1°, while in the Y-axis direction this spread was from −10° to +10°. For the purposes of illustration the trajectories of ions were computed over 50 time units only, which corresponds to approximately 16 complete oscillations in the X-axis direction and around 11 oscillations in the Z-axis direction. As can be seen from FIG. 8, the ion packet remains reasonably compact throughout the entire trajectory. In one practical example potential, $V_z$ was set to 100V, which resulted in a total flight energy of 312 eV. The length of the scaling parameter was set at l=40 mm, which resulted in a trajectory of +/−120 mm in Z-axis direction and of +/−140 mm in X-axis direction. Singly charged ions were injected with a relative energy spread of 10% energy, a +/−1° angular spread in the XZ plane and a +/−5 ° angular spread in the XY plane. After 20 complete reflections in the X-axis direction (a total flight time of 780 μs) the cloud size along the X-axis was less than 14 mm This size is smaller than the size of a typical detector (20 mm) and is comparable with the size of the exit slit, which, as will be described, may be provided within the system. Importantly the spread of flight times in the (Z-axis) flight direction is the same as the duration of the initial ion pulse because of the ideal energy focusing accomplished by the distribution of electrostatic potential $\Phi_{EF}$. Pulses of duration less than 10 ns for 1000 Da ions can be easily produced by modern ion sources even without the use of collisional cooling. Thus, the mass resolving power for the desired simulation is estimated to be R=0.5*780000 ns/10 ns=39000.

Although the energy spread can be infinite for the (Z-axis) flight direction, for the X-axis direction the acceptable energy spread is limited, and for this illustration is estimated to be 10%. Acceptance of the system in the Y-axis direction was found to be 10 mm*10° or 1745 mm*mrad. In the X-axis direction acceptance is estimated to be 10 mm*2° or 350 mm*mrad. These estimates are orders of magnitude higher than the values reported hitherto, while achieving similar resolution.

Figure 5:
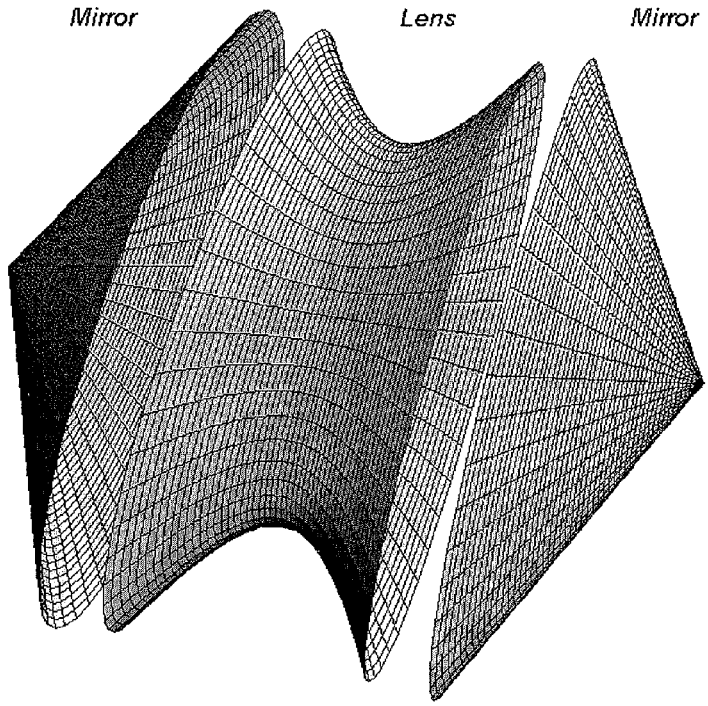

As already explained, the electrode structure for the ion optical device may have the form shown in FIG. 5. It comprises a set of curved electrically conducting electrodes that enclose a volume within which electrostatic field with specified properties is created by the application of corresponding DC voltages to the electrodes. According to the laws of physics, the total mechanical energy of ions in an electrostatic field is a conserved quantity. This implies that if ions are injected through a hole in one of the electrodes, they will eventually attain the same electrostatic potential; in other words they will hit the same electrode. This principle can be utilised to inject ions into the electrode structure from an external source and eject ions from the electrode structure to a detector via a hole in one of the electrodes. Alternatively, it is always possible simply to switch off one or more electrodes while ions are injected into or ejected from the electrode structure.

Figure 9:
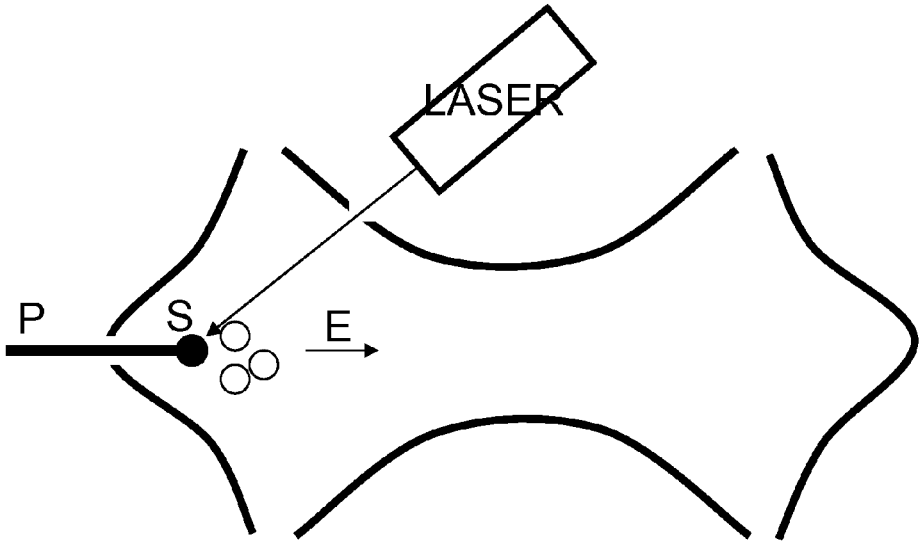

An alternative arrangement for injecting ions into the electrode structure includes an ion source S housed within the volume of the structure itself. The ion source could include a metal post P supporting a sample as shown in FIG. 9. Ions are generated by exposing the sample to a laser pulse and are drawn onto the flight path using an electrostatic extraction field. This approach is particularly suitable for sources which utilise matrix assisted laser desorption/ionization (MALDI). It is known that ions produced by a MALDI source have an initial distribution of velocities similar to that of neutral particles ablated from the surface of sample with average velocity around 800 m/s and velocity spread of +/−400 m/s independent of mass. For heavy ions this velocity corresponds to a very high energy: $Kz[eV] \propto 3.13 \cdot M[kDa]$ (here mass is in [kDa] for singly charged ions) and a substantial energy spread. In addition MALDI ions have very wide angular spread (up to) +/−60° in the direction orthogonal to the sample surface. With the use of uniform acceleration the angular spread can be significantly reduced, so that it will match with the acceptance of a proposed system. For example, for 1000 Da singly charged ions the lateral energy is 3.13 eV. After acceleration to 1200 eV, this spread is reduced to 2°. Such a spread is acceptable for the Y-axis direction of above described system, and more than enough for the X-axis direction. In the case of higher mass ions, acceleration to higher flight energies might be required. The acceleration can be produced by a potential difference between a metal sampling plate and a grid placed at some distance from the sample surface. Delayed extraction to reduce fragmentation will be appreciated by those who skilled in the art.

Acceptance of the proposed system is asymmetrical in the X-axis and the Y-axis lateral directions. This property is suitable for some advanced ion sources based on linear ion traps (LIT) for which the ion cloud is elongated along the ion trap axis. In such sources collisional cooling can be used in order to reduce emittance. A LIT source has much bigger charge capacity as compared to 3D ion trap sources and MALDI. With this in mind, in another embodiment of the invention, the ion optical device has the form of an ion trap utilising image current detection to generate a mass spectrum in response to ion motion within the ion trap.

Due to ideal energy focusing in the Z-axis (flight) direction ion packets of similar m/z do not spread out along the trajectory for many (in fact millions of) oscillations. It is known that charged particles induce surface charge on nearby electrodes. Due to the oscillations of the ion clouds within the ion trap the induced charge creates an alternate current in a circuit connected to a pair of electrodes, which enclose the flight region. This current can be measured by a sensitive galvanometer and recorded. Fourier transform (FT) of the time domain signal will exhibit a mass spectrum of the sample due to the fact that the frequency of ion oscillations in a quadratic potential is inversely proportional to the square root of m/z. Thus an ion optical device according to the invention can be used as an electrostatic ion trap utilising image current detection and FT processing:

In another embodiment of the invention, the ion optical device has the form of an ion trap storage device. For this embodiment, ion motion within the electrostatic field of the device preferably exhibits fundamental stability, which means that, in practice, for a selected range of initial energies and injection angles the motion of ions remains finite and confined within a certain volume for an infinitely long period of time. This property enables the ion optical device to be used as an ion trap storage device. For example, if an ion beam having an energy spread, which falls completely within the energy acceptance window of the device, is injected with initial conditions which ensure stability of motion, then ions will undergo stable motion within a finite volume of device from which they can be ejected to another device for manipulation or mass analysis. Due to differences in periods of oscillation of ions of different energy the ion cloud, with time, will occupy the volume of stable motion completely. This is not an obstacle for using the device for ion storage. Being transferred downstream, the ion cloud can be cooled down and separated using techniques which are known in the art. The only way ions might be lost from the storage volume would be due to scattering by the neutral particles of residual gas and/or space charge interaction of ions. As for scattering, the pressure of residual gas can be always made sufficiently small to allow minimal losses over the storage period. Confinement of ions for more than several minutes is known in the art. As for space charge interaction, if this becomes a significant factor then the total number of ions injected into the storage device can be always reduced so that space charge interaction does not prevent trapping. Experimental data on the confinement of ions in electrostatic fields indicates that space charge interactions are more likely to improve confinement of ions in the storage device by creating bunches of ions of similar mass. So space charge effects are not always disadvantageous for an ion trap storage device of the proposed kind.

The described preferred embodiments are intended to be examples only and are not intended to be limiting. Alternative embodiments within the scope of the claims will be envisaged by persons of ordinary skill in the art.

The invention claimed is:

1. A multi-reflecting ion optical device comprising electrostatic field generating means configured to generate electrostatic field defined by a superposition of first and second mutually independent distributions of electrostatic potential ($\Phi_{EF}$, $\Phi_{LS}$ , whereby ion motion in a flight direction is decoupled from ion motion in lateral directions, orthogonal to the flight direction, said first distribution of electrostatic potential ($\Phi_{EF}$ being effective to subject ions having the same mass-to-charge ratio to energy focusing with respect to the flight direction and said second distribution of electrostatic potential $\Phi_{LS}$ being effective to subject ions to stability in one said lateral direction, to stability in another said lateral direction for the duration of at least a finite number of oscillations in said one lateral direction and to subject ions having the same mass-to-charge ratio to energy focusing with respect to said one lateral direction for a predetermined energy range.

2. An ion optical device as claimed in claim 1 wherein said first distribution of electrostatic potential $\Phi_{EF}$ is effective to subject ions having the same mass-to-charge ratio to ideal energy focusing with respect to the flight direction.

3. An ion optical device as claimed in claim 1 wherein said second distribution of electrostatic potential $\Phi_{LS}$ has the form:

$$\Phi_{LS} = \phi(x) - y^2\phi''(x) + \frac{y^4}{24}\phi^{(4)}(x) - \frac{y^6}{720}\phi^{(6)}(x) + \ldots$$

wherein x and y respectively represent distance along mutually orthogonal X- and Y-axis lateral directions, $\phi(x)$ represents the distribution of electrostatic potential as a function of distance x along the X-axis direction and $\phi''(x)$, $\phi^{(4)}(x)$ and $\phi^{(6)}(x)$ are respectively the second, fourth and sixth derivatives of $\phi(x)$ with respect to distance x.

4. An ion optical device as claimed in claim 1 wherein said second distribution of electrostatic potential $\Phi_{LS}$ has the form defined by equations 14 and 15 described herein.

5. An ion optical device as claimed in claim 1 having the form of a multi-reflecting time-of-flight mass analyser.

6. A time-of-flight mass spectrometer including an ion source for supplying ions, a multi-reflecting time-of-flight mass analyser as claimed in claim 5 for analysing ions supplied by said ion source, and a detector for receiving ions having the same mass-to-charge ratio and different energies at substantially the same time after ions have been separated according to mass-to-charge ratio by the multi-reflecting time-of-flight mass analyser.

7. An ion optical device as claimed in claim 1 having the form of an ion trap.

8. An ion optical device as claimed in claim 7 wherein said ion trap includes image current detection means effective to generate a mass spectrum responsive to ion motion in the ion trap.

9. An ion optical device as claimed in claim 7 wherein said ion trap is arranged to carry out mass-selective ejection of ions to generate a mass spectrum.

10. An ion optical device is claimed in claim 7 wherein said ion trap is an ion trap storage device.

11. An ion optical device as claimed in claim 1 including an ion source mounted on and enclosed by an electrode structure of said electrostatic field generating means.

12. As ion optical device as claimed in claim 11 wherein said ion source is a MALDI ion source.

13. An ion optical device as claimed in claim 11 including means for irradiating the ion source with pulses of laser radiation introduced via an opening in an electrode of the electrode structure.

14. An ion optical device as claimed in claim 2 wherein said second distribution of electrostatic potential $\Phi_{LS}$ has the form:

$$\Phi_{LS} = \phi(x) - y^2\phi''(x) + \frac{y^4}{24}\phi^{(4)}(x) - \frac{y^6}{720}\phi^{(6)}(x) + \ldots$$

wherein x and y respectively represent distance along mutually orthogonal X- and Y-axis lateral directions, $\phi(x)$ represents the distribution of electrostatic potential as a function of distance x along the X-axis direction and $\phi''(x)$, $\phi^{(4)}(x)$ and $\phi^{(6)}(x)$ are respectively the second, fourth and sixth derivatives of $\phi(x)$ with respect to distance x.

15. An ion optical device as claimed in claim 2 wherein said second distribution of electrostatic potential $\Phi_{LS}$ has the form defined by equations 14 and 15 described herein.

16. An ion optical device as claimed claim 2 having the form of a multi-reflecting time-of-flight mass analyser.

* * * * *